US006406268B1

(12) United States Patent
Paice

(10) Patent No.: US 6,406,268 B1
(45) Date of Patent: Jun. 18, 2002

(54) CONTROL OF A COMPRESSOR UNIT

(75) Inventor: Andrew Paice, Baden-Dättwil (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/617,915

(22) Filed: Jul. 17, 2000

(30) Foreign Application Priority Data

Jul. 16, 1999 (EP) ..... 99810642

(51) Int. Cl.[7] ..... F04B 49/00

(52) U.S. Cl. ..... 417/53; 415/1; 417/26; 417/300

(58) Field of Search ..... 417/53, 26, 43, 417/300; 415/1, 15, 17, 27

(56) References Cited

U.S. PATENT DOCUMENTS

| | | | | | |
|---|---|---|---|---|---|
| 3,979,655 | A | | 9/1976 | Rutshtein et al. | 318/609 |
| 3,979,665 | A | * | 9/1976 | Rutshtein et al. | 318/609 |
| 4,046,490 | A | * | 9/1977 | Rutshtein et al. | 417/28 |
| 4,807,150 | A | | 2/1989 | Hobbs | 364/510 |
| 4,971,516 | A | * | 11/1990 | Lawless et al. | 415/1 |
| 5,306,116 | A | * | 4/1994 | Gunn et al. | 415/27 |
| 5,508,943 | A | * | 4/1996 | Batson et al. | 364/551.01 |

FOREIGN PATENT DOCUMENTS

| | | | |
|---|---|---|---|
| EP | 0 368 557 | 5/1990 | 415/27 |
| EP | 0 398 436 | 11/1990 | 415/27 |

OTHER PUBLICATIONS

Staroselsky et al. "Improved surge control for centrifugal compressors", May 21, 1979, Chemical Engineering, pp. 175–184.*

Staroselsky et al, "Improved surge Control for Centrifugal Compressors", May 21, 1979, Chemical Engineering, pp 175–184.*

* cited by examiner

*Primary Examiner*—Charles G. Freay
*Assistant Examiner*—Han L Liu
(74) *Attorney, Agent, or Firm*—Burns, Doane, Swecker & Mathis, L.L.P.

(57) ABSTRACT

A controller for a compressor determines a characteristic variable for an overall flow to be supplied, and generates on the basis of this characteristic variable, by means of static functions, a first setpoint value for a row of inlet guide vanes or an inlet valve or a rotational speed of the compressor and a second setpoint value for a return valve.

In a preferred embodiment of the subject-matter of the invention, the overall flow is set in a normal operating range by variation of the first setpoint value, and when a safety limit lying before a surge limit is exceeded is set by variation of the second setpoint value. Advantageously, the overall flow thereby changes continuously during the transition between these operating ranges.

The simple controller dynamics also mean that the dynamics of the compressor unit are not further complicated, and the control system remains simple to design, put into operation and maintain.

12 Claims, 2 Drawing Sheets

CONTROL OF A COMPRESSOR UNIT

FIELD OF THE DESCRIPTION

1. Technical Field

The invention relates to the field of control technology. It relates to a method and a device for controlling a compressor unit.

BACKGROUND OF THE INVENTION

2. Prior Art

A turbocompressor is inherently stable during normal operation: on the basis of the inlet and outlet pressure as well as parameters of the compressor, a mass flow of a working fluid through the compressor is established. This flow, which may be considered as a volume flow or mass flow, decreases as the pressure differential increases, so that the pressures and the flow move toward a state of equilibrium. With a falling pressure differential, a stable operating range is limited by a so-called surge limit: with increasing outlet pressure, the mass flow falls to a certain minimum. After exceeding the surge limit, the mass flow flows back through the compressor. As a result, the outlet pressure falls, until the mass flow flows forward again. This cycle, known as surging, is repeated and may mechanically damage or destroy the compressor. Therefore, apart from controlling an outlet pressure or flow, it is a task of a compressor controller to avoid surging. For this purpose, as described in U.S. Pat. No. 4,807,150, usually a blowoff or return valve is opened, allowing part of the compressed working fluid to escape, or returning it to the inlet of the compressor. At the same time as the valve opens, the rotational speed of the compressor may also be varied, as disclosed in U.S. Pat. No. 5,306,116. The additional mass flow through the return valve prevents the mass flow through the compressor from going below the surge limit. Usually, the compressor and the return valve are controlled by their own closed-loop control circuits.

For safety reasons, the return valve is already opened before the surge limit is exceeded. A corresponding safety limit should be as far as possible from the surge limit. To optimize efficiency, on the other hand, the safety limit should be as close as possible to the surge limit. This requires safety precautions which increase the complexity of the control circuits.

A combination of a compressor with a return valve is referred to hereafter as a compressor unit. A compressor unit which supplies a gas turbine with gaseous fuel must satisfy high requirements concerning pressure control. For example, when there are abrupt changes in the load of the gas turbine and an associated change in gas consumption, the output pressure of the compressor must be maintained without a flame of the gas turbine being extinguished, and without lines being damaged due to excessive pressures. During normal operation, no oscillations may occur in the gas delivery. Depending on the controller concept of the gas turbine, it is also possible that a compressor unit must supply a prescribed mass flow. In the case of hydraulic systems, on the other hand, control to a prescribed volume flow is of interest.

Axial- or radial-flow compressors are equipped with adjustable rows of inlet guide vanes for the purpose of varying the flow rate. Another way of varying the flow rate uses a variable-speed drive of the compressor. Given constant inlet and outlet conditions, in both cases the mass flow is dependent on an angle of the row of inlet guide vanes and, respectively, a rotational speed. A corresponding controller for a compressor unit controls at least two manipulated variables, for example the angle of the row of inlet guide vanes and the return valve. The existing controller structures are complex and have decoupled controllers for the two manipulated variables, which usually makes a systematic controller design impossible. Instances of switching over between different operating states make the dynamics of the controller and consequently of the compressor obscure and consequently even more difficult to design and put into operation.

It is therefore the object of the invention to provide a method and a device for controlling the outlet pressure of a compressor unit which has a simple structure and makes a systematic controller design possible.

This object is achieved by a method and a device for controlling the outlet pressure of a compressor unit having the features of patent claims 1 and 7.

In the controller according to the invention for a compressor unit which has a compressor and a return valve, a characteristic variable for an overall flow to be supplied is determined, and a first setpoint value for a row of guide vanes or an inlet valve or a rotational speed of the compressor and a second setpoint value for a return valve are generated on the basis of this characteristic variable by means of static functions.

The overall flow to be supplied is preferably a mass flow, but may also be a volume flow.

In a preferred embodiment of the subject-matter of the invention, the overall flow is set in a normal operating range by variation of the first setpoint value, and when the normal operating range is left is set by variation of the second setpoint value. Advantageously, the overall flow thereby changes continuously during the transition between these operating ranges.

In a further preferred embodiment of the subject-matter of the invention, the static functions for determining the first and second setpoint values are linear.

Parameters of the static functions are advantageously adapted to an operating state of the compressor.

Further preferred embodiments emerge from the dependent patent claims.

BRIEF DESCRIPTION OF THE DRAWINGS

Preferred embodiments of the invention are disclosed in the following description and illustrated in the accompanying drawings, in which.

DETAILED DESCRIPTION OF THE INVENTION

Figure 1:
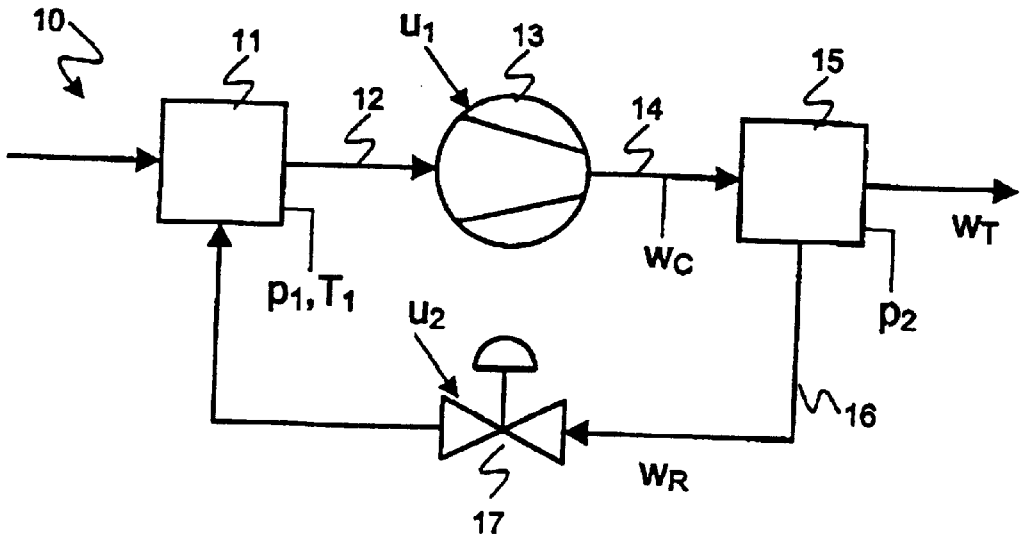
FIG. 1 shows a schematic representation of a compressor unit.

The designations used in the drawings and their meaning are compiled in the list of designations. In principle, the same parts are provided with the same designations in the figures.

WAYS OF IMPLEMENTING THE INVENTION

FIG. 1 shows a compressor unit 10, to which a control system according to the invention relates. A working fluid, for example air, a gas or a hydraulic oil, passes from a generator or a reservoir into a mixer 11, in which the working fluid has an inlet pressure $p_1$ and an inlet temperature $T_1$. From the mixer, the working fluid passes through an inlet 12 into a compressor 13. The compressor 13 has a signal input for a first setpoint value $u_1$. This setpoint value is used, for example by means of a subordinate closed-loop control circuit, to adjust a characteristic parameter of the compressor 13, for example an angle of a row of inlet guide vanes or a position of an inlet valve or a rotational speed of the compressor. At an outlet 14 of the compressor 13, a compressor flow $w_C$ flows into a branch 15, in which the working fluid has an outlet pressure $p_2$. From the branch 15, an overall flow $w_T$ flows on to a consumer, and a return flow $w_R$ flows through a return flow line 16 and a controllable return valve 17 back into the mixer 11. The return valve 17 has a signal input for a second setpoint value $u_2$. This second setpoint value is used, for example by means of a subordinate closed-loop control circuit, to adjust a valve lift of the return valve 17.

In another embodiment of the invention, the working fluid does not pass through the return valve 17 to the compressor inlet but is blown off into the surroundings. In this case, the return valve 17 is referred to as a blowoff valve. The control system according to the invention is presented below on the basis of a return valve 17, but can be used for both ways of using valves.

Figure 2:
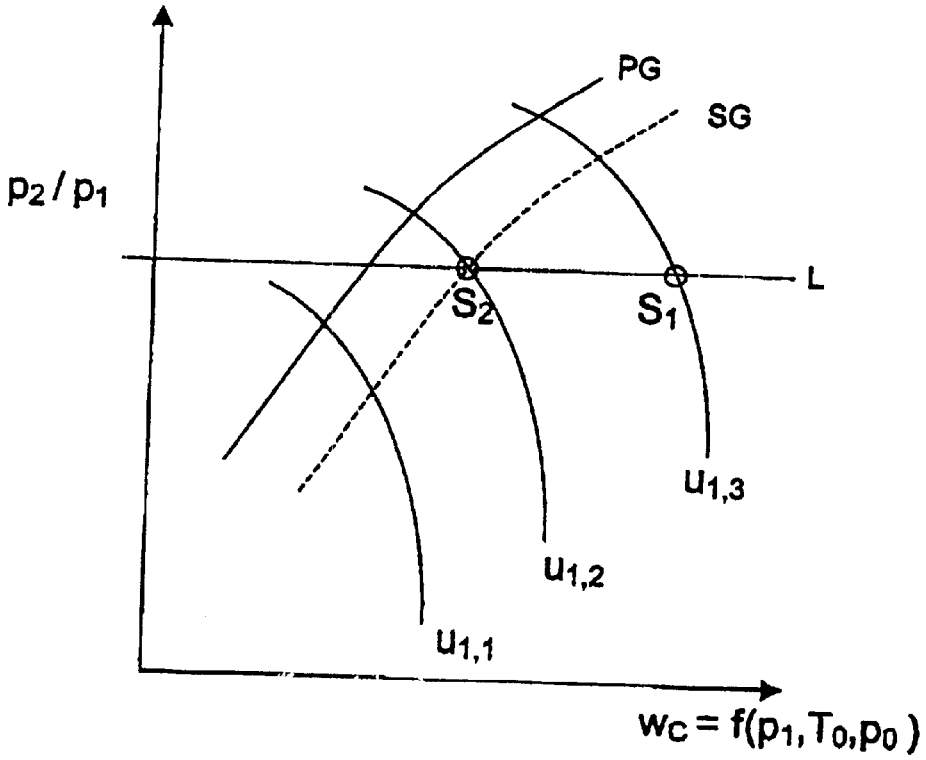
FIG. 2 shows a characteristic map of a compressor.

FIG. 2 schematically shows a typical characteristic map of the compressor 13. Plotted along a y-axis is a pressure ratio $p_2/p_1$ between the outlet pressure and inlet pressure. Plotted along an x-axis is the compressor flow $w_C$, which for the following explanations is considered as a mass flow (for example in kg/second). This compressor flow $w_C$ is usually scaled with the inlet temperature $T_1$ and normalized to a given operating state $T_0$, $p_0$, so that the same graphic representation of the characteristic map can be used for different inlet temperatures $T_1$.

In other representations of the characteristic map, an outlet pressure $p_2$ with a constant inlet pressure or a difference in the enthalpy of the working fluid between inlet 12 and outlet 14 is plotted for example along the y-axis. Similarly, a volume flow (for example in $m^3$/second) may be plotted along the horizontal axis instead of the mass flow. In such other representations of the characteristic map, the characteristic map is just scaled differently, without altering the principle of the control system explained below.

Characteristic curves denoted by $u_{1,1}$ to $u_{1,3}$ indicate the behavior of the compressor for various values of the characteristic parameter determined by $u_1$. For example, for a specific value of $u_1$ and for a given pressure ratio $p_2/p_1$, a value of the compressor flow $w_C$ which lies on the line corresponding to $u_1$ is established. It is evident here that, when there is an increase in the pressure ratio $p_2/p_1$, for example due to an increase in the outlet pressure $p_2$, the compressor flow $w_C$ decreases. If the compressor flow $w_C$ goes below the surge limit, that is to say the line denoted by PG, the surging described at the beginning occurs. The surge limit PG is determined experimentally, for example during commissioning, and/or theoretically. For safety reasons, a safety limit SG is introduced. A control system is to intervene as soon as the compressor flow $w_C$ goes below the safety limit SG, so that it is guaranteed that it never goes below the surge limit PG.

Figure 3:
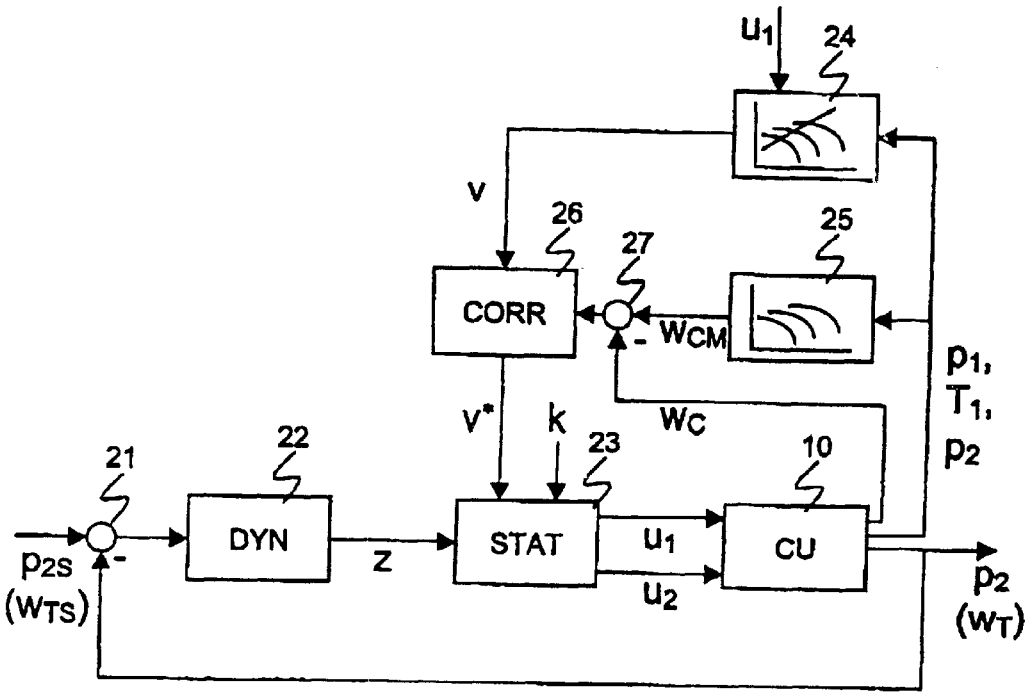
FIG. 3 shows a structure of a controller according to the invention.
Figure 4:
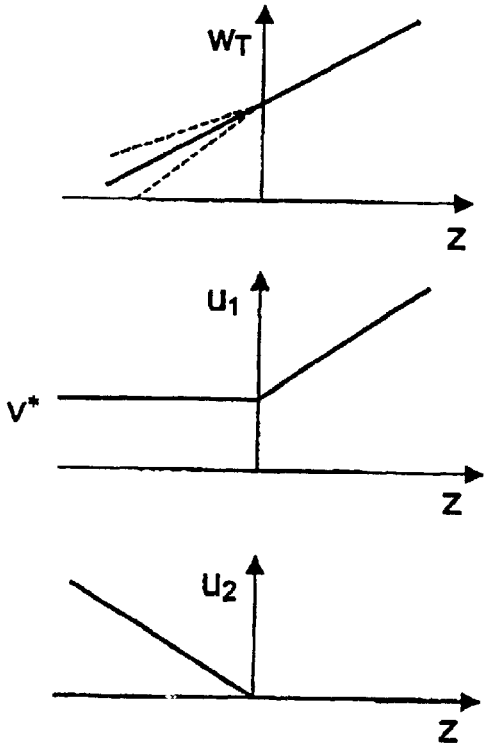
FIG. 4 shows relationships between various variables of the controller according to the invention.

FIG. 3 shows a block diagram of a control system according to the invention. Contained in it is the compressor unit 10 already described, with its input and output variables. A value from a measurement of the outlet pressure $p_2$ of the compressor unit 10 with a negative operational sign together with an outlet pressure setpoint value $p_{2S}$ lead to a first summation node 21. A difference or system deviation formed in the first summation node 21 leads to a preferably dynamic controller 22, which is for example a PI (Proportional-Integral) controller, a PID (Proportional-Integral-Differential) controller or a non-linear controller. An output of the controller 22 has a value z and leads to the input of a static setpoint generator 23. Two outputs of this static setpoint generator 23, with the values $u_1$ and $u_2$, lead to the compressor unit 10. Measured values of the operating conditions of the compressor unit, that is to say inlet pressure $p_1$, inlet temperature $T_1$ and outlet pressure $p_2$, lead to compressor characteristics 24 and 25. The method according to the invention functions as follows: the first summation node 21 forms a system deviation $P_{2S}-P_2$. The dynamic controller 22 calculates from this the characteristic variable z. If the dynamic controller 22 is a PI controller, z is calculated as $$x_1=P_{2S}-P_2$$

$$x_2=x_1$$

$$z=ax_1+bx_2$$

a and b being parameters of the PI controller, On the basis of the value of z, the static setpoint generator 23 determines a first setpoint value $u_1$ and a second setpoint value $u_2$ as $$\begin{aligned} z>0 &\Rightarrow u_1=z+v\star \\ &\quad\;\; u_2=0 \\ z=0 &\Rightarrow u_1=v\star \\ &\quad\;\; u_2=0 \\ z<0 &\Rightarrow u_1=v\star \\ &\quad\;\; u_2=-kz \end{aligned}$$

where v* is a modified first statics parameter and k is a second statics parameter. The value of v* is chosen in dependence on the measured values $p_1$, $T_1$, $p_2$ of the compressor unit 10 in such a way that the operating state of the compressor for $u_1$=v* and $u_2$=0 lies on the safety limit SG. Corresponding to this operating state is a value of z=0, as can be seen from the above equations for $u_1$ and $u_2$. Any other value of z can also be assigned to this operating state, although this would only make the equations more complicated, without altering their functionality. FIG. 4 shows by way of example the relationships described above between the characteristic variable z, the setpoint values $u_1$ and $u_2$ and the overall flow $w_T$.

The setpoint values $u_1$ and $u_2$ formed in the static setpoint generator 23 are transmitted to the compressor unit 10. The first setpoint value $u_1$ is used, for example by means of a subordinate closed-loop control circuit, to adjust in the compressor unit 10 a characteristic parameter of the compressor 13, in particular an angle of a row of inlet guide vanes or a position of an inlet valve or a rotational speed of the compressor. When doing so, a characteristic curve of the comparator 13 in FIG. 2 shifts for increasing values of $u_1$ from the curve identified by $u_{1,1}$ via the curve identified by $u_{1,2}$ to the curve identified by $u_{1,3}$. This increase in $u_1$ corresponds to an opening of the row of inlet guide vanes or an opening of the inlet valve or an increase in the rotational speed of the compressor 13. For the sake of simplicity, only the control system with adjustable rows of inlet guide vanes is described below. However, the ideas and the control system can also be readily applied to an adjustable inlet valve or a variable-speed compressor 13.

The second setpoint value $u_2$ is used, for example by means of a subordinate closed-loop control circuit, to adjust in the compressor unit 10 the valve lift of the return valve 17. In this case, an increase in $u_2$ corresponds to an opening of the return valve 17 and an increase in the return flow $w_R$. For $u_{2=0}$, the return valve 17 is closed.

Corresponding to the values of $u_1$ and $u_2$ as well as a characteristic of the consumer, an overall flow $w_T$ and an outlet pressure $p_2$ are established. If this outlet pressure $p_2$ is, for example, higher than the setpoint outlet-pressure value $p_{2S}$, the system deviation becomes negative and the dynamic controller 22 leads to a decrease in the characteristic variable z. The resultant change in the setpoint values $u_1$ and $u_2$ is explained with reference to FIG. 2: the compressor would be in a state denoted by S1 [sic] in a normal operating range of the compressor, that is to say the compressor flow $w_C$ is greater than at a point on the safety limit SG with the same pressure ratio. Consequently, $u_2=0$ and the return valve 17 is closed, the overall flow $w_T$ is equal to the compressor flow $w_C$ and is controlled by the first setpoint value $u_1$ and adjustment of the row of inlet guide vanes. The decrease in z leads via $u_1$ to a closing of the row of inlet guide vanes and to a reduction in the overall flow $w_T$. For small changes, the pressure ratios are considered to be constant, so that the state of the compressor 13 shifts along a line L in the direction of the safety limit SG and the overall flow $w_T$ decreases. If the state reaches a point denoted by S2 [sic] on the safety limit SG, this corresponds to a value of z=0 as a result of the choice described above of v* and because $u_1=z+v^*$. If z continues to becomes smaller, $u_1=v^*$ remains and consequently the state of the compressor remains at the point S2 [sic] on the safety limit. On the other hand, the return valve 17 is opened according to $u_2=-k\cdot z$, so that the overall flow $w_T$ then continues to decrease according to the difference between compressor flow $w_C$ and return flow $w_R$. The value of k is chosen such that a gradient of the overall flow $w_T$ in dependence on z at the transition to the opening of the return valve 17 remains at least approximately constant, that is to say it is $$\left(\left(k = \frac{\partial w_T}{\partial u_1}\right)\right)_{z=0+}\left(-\frac{\partial w_T}{\partial u_2}\right)^{-1}\Bigg)\Bigg)_{z=0-}$$

In FIG. 4, the dashed lines indicate the variation in the overall flow $w_T$ if k is not chosen as described above. In a further variant of the invention, k is adapted to the operating state of the compressor by means of a compressor characteristic.

The controller according to the invention has the advantage that the essential controller dynamics can be determined by the dynamic controller 22, and that this controller acts only on one characteristic variable z. This obviates problems occurring with dynamic multi-variable controllers of coordinating dynamic processes during design and operation. This becomes possible by the way in which, according to the invention, the compressor unit is considered and controlled as an complete entity and by the static determination of the setpoint values $u_1$ and $u_2$ from the individual characteristic variable z.

It is described below how the state-dependent first statics parameter v and the modified first statics parameter v* are determined: the first compressor characteristic 24 determines the first statics parameter v from the measured values of the compressor unit 10, that is from the inlet pressure $p_1$, inlet temperature $T_1$ and outlet pressure $p_2$, as well as from the known value of the first setpoint value $u_1$. For this purpose, for example, a description of the compressor characteristic curves by an equation of the form $$w_{CM}=f(u_1, p_1, p_2, T_1)$$

is taken as a basis. This determines a modelled compressor flow $w_{CM}$ in dependence on $u_1$ and on the measured values of the compressor unit 10. Likewise given as an element of the compressor characteristic 24 is an equation which calculates a so-called surge error $s_E$, that is to say a distance of a compressor state from the safety limit SG, $$\begin{aligned} S_E &= h(W_{CM}, p_1, p_2, T_1) \\ &= h(f(u_1, p_1, p_2, T_1), p_1, p_2, T_1) \end{aligned}$$

The value of $u_1$ for which this expression become zero is equal to the sought value of the first statics parameter v.

The above equations for describing the compressor characteristic curves and the surge error are implicitly contained in the compressor characteristics 24, 25 and correspond to a static model of the compressor behavior. The equations are determined by measurements and/or theoretical analyses. They are advantageously scaled, normalized and stored in tabular form. The determination of $u_1$ and v respectively takes place for example by numerical resolution of the equation for the surge error $s_E$, or by solutions of the equation being calculated and put in tables in advance.

A real compressor 13 will deviate in its behavior from the modelled, expected compressor characteristics. To balance out this deviation of the compressor characteristics 24, 35 from the behavior of a real compressor, the first statics parameter v is corrected on the basis of a measurement, so that the transition between the control by the row of inlet guide vanes and the control by the return valve 17 remains on the safety limit SG, and in particular is not shifted in the direction of the surge limit. Chosen for example as the measurement is the compressor flow $w_C$. In a second compressor characteristic 25, the modelled compressor flow $w_{CM}$ is determined in accordance with the equation already shown above. The measured compressor flow $w_C$ is subtracted from this modelled compressor flow $w_{CM}$ in the summation block 21. On the basis of the difference $w_{CM}-w_C$, the modified first statics parameter v* is determined in the correction unit 26, for example as $$v^*=v+K(w_{CM}-w_C)$$

K being a constant. Instead of this linear correction, a non-linear and/or a dynamic dependence of v* on the difference $w_{CM}-w_C$ [sic] is also used, for example.

If the measurement of the compressor flow $w_C$ does not take place, a warning signal is advantageously emitted and the control is continued with a value of $w_C$ last measured. Since a relevant deviation of the behavior of a real compressor from the modelled compressor behavior develops over a period of days to weeks, this is not critical.

In a further variant of the controller according to the invention, the overall flow $w_T$ is prescribed instead of the outlet pressure $p_2$. In this case, the same structure as in FIG. 3 is used, but with different coefficients of the dynamic controller 22. The controlled overall flow $w_T$ is optionally a mass flow or a volume flow. In a further variant of the controller according to the invention, the dynamic controller 22 is a combined feedforward/feedback controller with $p_{2S}$ and $w_{TS}$ as inputs, or a controller cascade for $p_2$ and $w_T$. Similarly, further controller variants are possible, all based on the idea of a common characteristic variable for a characteristic parameter and the return valve 17.

In a preferred variant, the control system according to the invention is used for controlling a radially acting gas compressor for supplying fuel to a gas turbine. The first setpoint variable $u_1$ in this case prescribes values for an adjustable row of inlet guide vanes. This control system for a gas compressor was tested in simulations, the gas requirement of the gas turbine being reduced from 100% to 10% within 4 seconds. The control system behaves at least just as well as conventional, much more complicated control structures.

| List of designations | |
|---|---|
| 10 | compressor unit |
| 11 | mixer |
| 12 | inlet |
| 13 | compressor |
| 14 | outlet |
| 15 | branch |
| 16 | return flow line |
| 17 | valve, return valve |
| 21 | first summation node |
| 22 | dynamic controller |
| 33 | static setpoint generator |
| 24 | first compressor characteristic |
| 25 | second compressor characteristic |
| 26 | correction unit |
| 27 | second summation node |
| k | second statics parameter |
| $P_1$ | inlet pressure |
| $P_2$ | outlet pressure |
| $P_{2s}$ | setpoint outlet-pressure value |
| PG | surge limit |
| $S_E$ | surge error |
| SG | safety limit |
| $T_1$ | inlet temperature |
| $u_1$ | first setpoint value |
| $u_2$ | second setpoint value |
| v | first statics parameter |
| v* | modified first statics parameter |
| $W_C$ | compressor flow |
| $W_{CM}$ | modelled compressor flow |
| $W_R$ | return flow |
| $W_T$ | overall flow |
| $W_{TS}$ | setpoint overall flow value |
| z | characteristic variable |

What is claimed is:

1. A control method for a compressor unit, comprising the steps of:

providing a compressor and a valve, the valve being a return valve or a blowoff valve, the compressor having a compressor flow $w_C$, the valve having a return flow $w_R$, and an overall flow $w_T$ being equal to a difference $w_C-w_R$; and inputting a single variable z representing an overall flow $w_T$ to be supplied to a first static function that calculates a first setpoint value $u_1$ for controlling a row of inlet guide vanes or an inlet valve or a rotational speed of the compressor; and inputting the variable z to a second static function that calculates, a second setpoint value $u_2$ for controlling the valve.

2. The control method as claimed in claim 1, wherein the overall flow $w_T$ is controlled in a normal operating range by varying the first setpoint value $u_1$, the valve remaining closed, and for values of the overall flow $w_T$ which for a pressure ratio prevailing at the compressor are smaller than in a normal operating range is controlled by varying the second setpoint value $u_2$ and the valve, the first setpoint value $u_1$ being left constant.

3. The control method as claimed in claim 1, wherein the static functions are chosen such that they are piecewise linear.

4. The control method as claimed in claim 1, wherein the calculation of the setpoint values takes place for $z>0$ as $u_1=z+v^*$ and $u_2=0$, for $z=0$ as $u_1=v^*$ and $u_2=0$, and for $z<0$ as $u_1=v^*$ and $u_2=-k\cdot z$, the value of v* being a value of the first setpoint value at which a state of the compressor is on a safety limit (SG) before a surge limit (PG), and the value of k being determined such that a gradient of the overall flow $w_T$ in dependence on the variable z at the transition over a point z=0 remains at least approximately constant.

5. The control method as claimed in claim 4, wherein the value of v* is calculated on the basis of a first compressor characteristic and on the basis of measured values of operating conditions of the compressor unit, and is thereby adapted to the state of the compressor.

6. The control method as claimed in claim 5, wherein the value of v* is corrected on the basis of a second compressor characteristic and on the basis of measured values of the compressor flow $w_C$, and deviations of the compressor characteristics from the behavior of the compressor are thereby balanced out.

7. A device for controlling a compressor unit, the compressor unit having a compressor and a valve, the valve being a return valve or a blowoff valve, the compressor having a compressor flow $w_C$, the valve having a return flow $w_R$, and an overall flow $w_T$ being equal to a difference $w_C-w_R$, wherein the device has a static setpoint generator with a first static function for calculating a first setpoint value $u_1$ for controlling a row of inlet guide vanes or an inlet valve or a rotational speed of the compressor and with a second static function for calculating a second setpoint value $u_2$ for controlling the valve, the static functions having as input a common variable z representing an overall flow $w_T$ to be supplied.

8. The device as claimed in claim 1, wherein the overall flow $w_T$ in a normal operating range is dependent on the first setpoint value $u_1$, the valve being closed, and for values of the overall flow $w_T$ which for a pressure ratio prevailing at the compressor are smaller than in the normal operating range is dependant on the second setpoint value $u_2$ and the position of the valve, the first setpoint value $u_1$ being constant.

9. The device as claimed in claim 7, wherein the static functions are piecewise linear.

10. The device as claimed in claim 7, wherein in the calculation, the setpoint values $u_1$ and $u_2$ are for $z>0$ equal to $u_1=z+v^*$ and $u_2=0$, for $z=0$ equal to $u_1=v^*$ and $u_2=0$, and for $z<0$ equal to $u_1=v^*$ and $u_2=-k\cdot z$, the value of v* being a value of the first setpoint value at which a state of the compressor is on a safety limit (SG) before a surge limit (PG), and the value of k being such that a gradient of the overall flow $w_T$ is dependent on the variable z at the transition over a point z=0 remains at least approximately constant.

11. The device as claimed in claim 10, further comprising: a first compressor characteristic for determining the value of v* and for adapting the value of v* to the state of the compressor on the basis of measured values of operating conditions ($p_1$, $T_1$, $p_2$) of the compressor unit.

12. The device as claimed in claim 11, further comprising: a second compressor characteristic for generating a modeled compressor flow $w_{CM}$, and a correction unit for correcting the value of v* and for balancing out deviations of the compressor characteristics from the behavior of the compressor on the basis of a difference between the modeled compressor flow $w_{CM}$ and measured values of the compressor flow $w_C$.

* * * * *